US005816091A

United States Patent [19]

Sautter et al.

[11] Patent Number: 5,816,091

[45] Date of Patent: Oct. 6, 1998

[54] WIRE SHAPING APPARATUS, IN PARTICULAR UNIVERSAL SPRING WINDING MACHINE, WITH CUTTING DEVICE

[75] Inventors: Dietmar Sautter, Lichtenstein/Württ.; Walter Maier, Mössingen/Württ.; Stefan Holder, Pliezhausen/Württ.; Dietmar Stolfig, Metzingen/Württ., all of Germany

[73] Assignee: Wafios Maschinenfabrik GmbH & Co. K.G., Germany

[21] Appl. No.: 823,812

[22] Filed: Mar. 24, 1997

[30] Foreign Application Priority Data

Mar. 25, 1996 [DE] Germany ..... 196 11 661.9

[51] Int. Cl.[6] ..... B21F 3/04; B21F 11/00

[52] U.S. Cl. ..... 72/145; 72/129

[58] Field of Search ..... 72/139, 131, 132, 72/145, 146, 324, 334, 338, 135; 83/639.1, 564

[56] References Cited

U.S. PATENT DOCUMENTS

| | | | |
|---|---|---|---|
| 3,224,310 | 12/1965 | Bieri | 83/639.1 |
| 3,407,639 | 10/1968 | McNair | 83/639.1 |
| 3,438,129 | 4/1969 | Spangler | 72/639.1 |
| 3,934,445 | 1/1976 | Lampietti | 72/129 |
| 4,724,733 | 2/1988 | Suarez et al. | 72/129 |
| 4,779,502 | 10/1988 | Hebert | 83/639.1 |

FOREIGN PATENT DOCUMENTS

3623079 C2 9/1986 Germany .

*Primary Examiner*—Joseph J. Hail, III
*Assistant Examiner*—Rodney Butler
*Attorney, Agent, or Firm*—Renner, Otto, Boisselle & Sklar, P.L.L.

[57] ABSTRACT

In order to obtain better noise protection, longer service life of machine and tools, and to increase the productivity of wire shaping apparatuses, in particular, a universal spring winding machine with a cutting device (16) consisting essentially of a movable cutting tool (38) with drive (80) and a stationary cutting tool (150) at which the endless intaken wire is cut, this invention suggests:

to conceive the drive of the cutting tool (38) in the form of a fluid operated cylinder piston aggregate cutting cylinder (80) with program-controllable NC valve (78);

to fix the movable cutting tool (38) by means of an adapter (158) to the movable part of the aggregate (piston rod 154);

to bring the moving direction of the latter (154) into accordance with the shearing direction of the movable cutting tool (38).

17 Claims, 7 Drawing Sheets

WIRE SHAPING APPARATUS, IN PARTICULAR UNIVERSAL SPRING WINDING MACHINE, WITH CUTTING DEVICE

This invention relates to a wire shaping apparatus.

The invention relates in particular to the cutting operation of spring winding machines by which the coiled spring is separated from the endless wire, especially in large-size spring winding machines having a working range of wire diameters up to 20 mms, for example for the manufacture of cold-formed vehicle suspension springs.

BACKGROUND OF THE INVENTION

Since long ago, spring winding machines with straight cut have been known (see for ex. CH-Z. technica, 1968, No. 10, p. 839841, in partic. FIG. 2), where the springs are cut by a straight up and downward movable knife moved by a rigidly mounted carriage against a stationary cutting mandrel. This has been the most frequently used cutting device for spring winding machines up to now.

The drive for the cutting knife movement of a known large-size spring winding machine ("FUL 10") is provided by the intake motor. For this purpose the wire feed (intake rolls) is stopped by means of a coupling when the spring length and the number of windings are reached and simultaneously the apparatus switches over to the drive of the cutting shaft. For each cutting movement the cutting shaft makes one turn. The movement of the cutting eccentric sitting on said shaft is transmitted over several levers, transmission and connection links, to the cutting knife sitting at the outside front of the machine and sliding in a rigidly mounted carriage guide. This kind of movement and power transmission accumulates much elastic energy which, in case of very high cutting forces, is set free abruptly after cutting and thus causes high vibrations. Further, due to the numerous bearing and articulation points which in summary have considerable bearing play, said vibrations cause much noise when the play is reversed. Today much noise is no longer accepted by machine users and trade associations. Even the cutting blow absorbers provided in modern machines have brought no remarkable improvement. In addition, the high vibrations destroy the modern construction and control elements of the machine.

The stroke of the knife movement described above must be so dimensioned that the stroke traveled by the cutting edge of the knife during the manufacture of formed springs, f.ex. conical springs, corresponds at least to the maximum possible diameter difference between the largest and the smallest outside diameter of the spring so that it is no hindrance to the winding process of the spring.

This long stroke which the cutting knife has to make requires much time. And as mentioned before, during cutting the wire feed of the machine is stopped. So the production of another spring can not be started before the cutting knife has returned to its starting position on top.

SUMMARY OF THE INVENTION

For this reason it is the object of the present invention to provide a spring winding machine with high noise reduction (environmental protection), low vibrations (increased service life of the machine and its tools), higher performance (increased number of finished springs per unit of time), and which is rapidly convertible from right to left turning.

With regard to the type of spring winding machine described in claim 1, this object is achieved according to the invention by the characteristics described in claim 1. Advantageous embodiments and variations are described in the subclaims.

Due to the fact that with respect to the spring winding machine according to the invention the cutting force advantageously in the rear extension of the cutting knife is transmitted without or with a minimum number of play-causing transmission links directly to the cutting device, the noise is reduced to a minimum and the destructive vibrations are avoided. This is obtained by means of an electro-hydraulic NC drive in the form of a rapidly working hydraulic cylinder with appropriate control block installed in the extended line of force of the cutting knife. Said closed hydraulic drive forms a hydromechanical closed loop position control and can be operated extremely dynamically. It consists essentially of the components: hydraulic cylinder, control valve, set point instruction, acknowledgement, set point motor, and stroke position adjustment. Such drives are being used already for punching and nipple machines (see DE-Z. O+P "Ölhydraulik und Pneumatik" 36 (1992) No. 10.)

Due to the fact that the cutting knife is fixed directly in the lower piston rod end of the cylinder and is acting together with a counterknife in the form of the cutting mandrel sitting in the mandrel support, and due to the fact that the cylinder is firmly connected to the mandrel support, these parts form a compact cutting unit with closed power flow (cylinder—cutting knife—cutting mandrel—mandrel support—cylinder). All bearings of the cutting device of the spring winding machine which always include a certain bearing play, are outside of the power flow which is acting exclusively in a straight line over pulling and pressure elements.

The electro-hydraulic drive itself is running enormously quiet. During the whole working stroke there are no uncontrolled marches of pressure in the hydraulic system, even the "blow" of the cutting operation, caused by the separation of the steel wire material of the spring, has only a diminished effect.

In addition to the reduction of the cutting noise, in order to increase the performance of the spring winding machine and in avoidance of the long knife stroke required in machines of prior art for cutting off a completely wound spring, according to this invention said whole compact cutting unit consisting of cylinder with control block and cutting knife as well as mandrel support with cutting mandrel, is swivelled program-controlled away from the operating plane around a swivel axis provided at the cutting cylinder after termination of the cutting operation. Here it is an essential advantage of the invention that the mass center of gravity lies far above the cutting knife, so that the heavy part of the compact cutting unit lies close to the pivot point and is hardly to be moved. The lower part which is swivelled away has relatively little mass.

Here the cutting knife only needs a cutting stroke which corresponds approximatively to the diameter of the wire to be cut and which, if necessary, can be adjusted to the wire strength. Thereby the computer of the machine control determines the optimum cutting stroke which is transmitted to the electro-hydraulic NC drive of the cutting cylinder.

The program-controlled swivelling-in of the cutting unit for cutting can already be started when the last turn of the formed spring is wound, and the swivelling-out after the cut can be started when the knife strokes back. So for formed springs the sequence of operations is: intake (winding)—simultaneously swivelling-in—cutting—swivelling-out during backstroke of the knife. Cylindrical springs can be produced without swivelling away the cutting unit. The cut can be carried out immediately after the winding process. Another advantage of the electro-hydraulic NC drive of the cutting unit is that the cylinder piston is always clamped floatingly between the two oil surfaces of piston and piston rod so that it will not touch any mechanical stop neither at the upper nor at the bottom dead center. This provides an excellent hydraulic cut blow damping and consequently a considerable noise reduction.

It is another advantage that due to this the stroke position of the working piston of the cylinder can be changed independent from the working stroke. This means that the starting position of the working stroke of the working piston within the total stroke of the cylinder can be freely selected CNC controlled. This property of the spring winding machine according to the invention has the effect that cutting knives of different lengths, for example resharpened knives, can be used in the cutting unit, and that the position height of the cutting mandrel can be adjusted to the diameter of the spring to be wound, and that the starting position of the pitch tool of a pitch setting device, for example after change from one turning direction to another turning direction, with respect to the drawn in wire can be set CNC controlled reproducible without mechanical adjustment means, like this is described in more detail below.

Not only the mentioned free programmability of the NC drive of the cutting cylinder with respect to stroke position and working stroke, but also of speed, acceleration, dwell time, and power, include enormeous advantages.

BRIEF DESCRIPTION OF THE DRAWINGS

The invention will now be explained in detail with reference to the preferred embodiment of the machine according to the invention illustrated by way of example (and partly schematically) in the drawings, in which.

DETAIL DESCRIPTION

Figure 1:
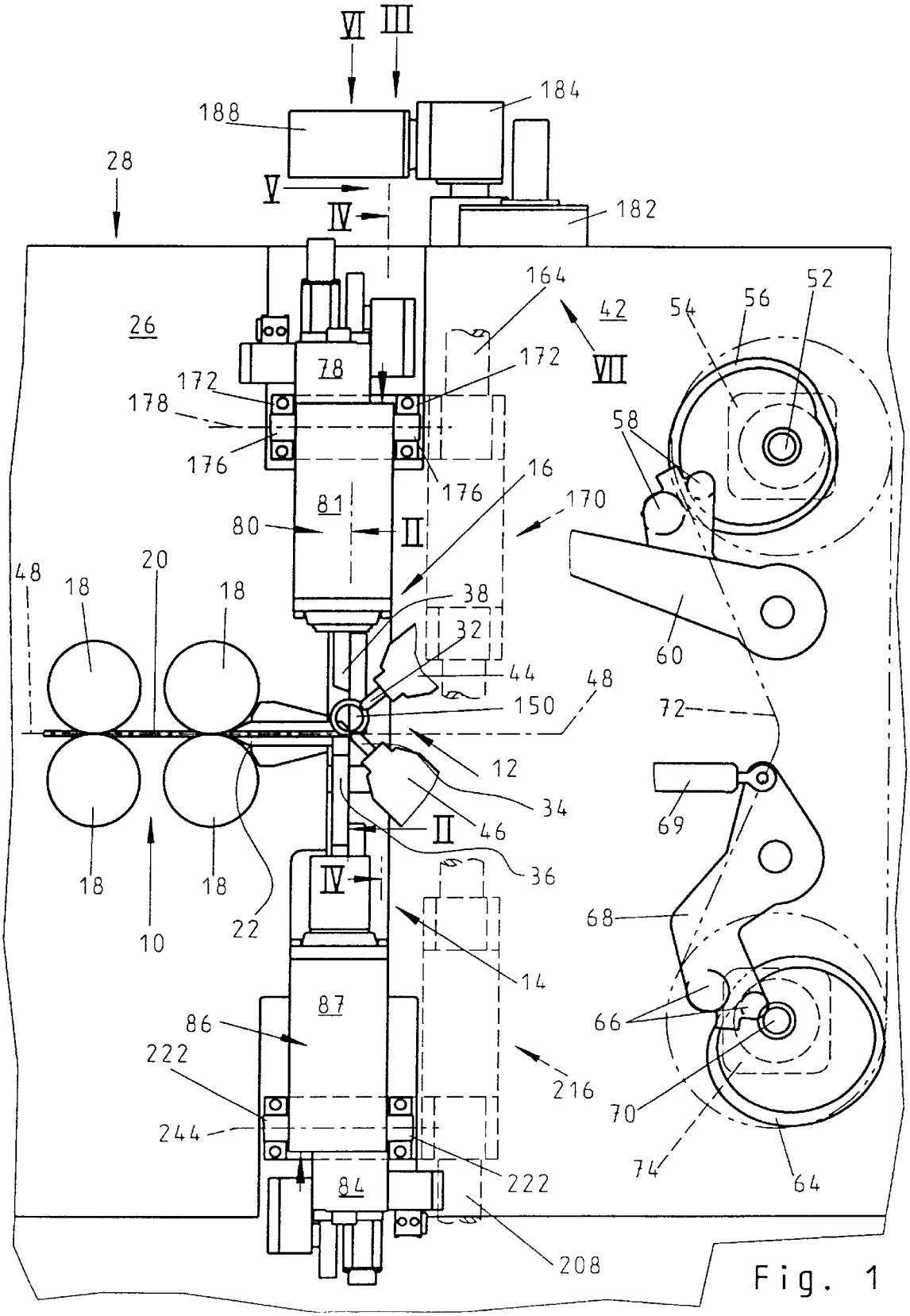
FIG. 1 is a front view of the embodiment partly broken away.
Figure 2:
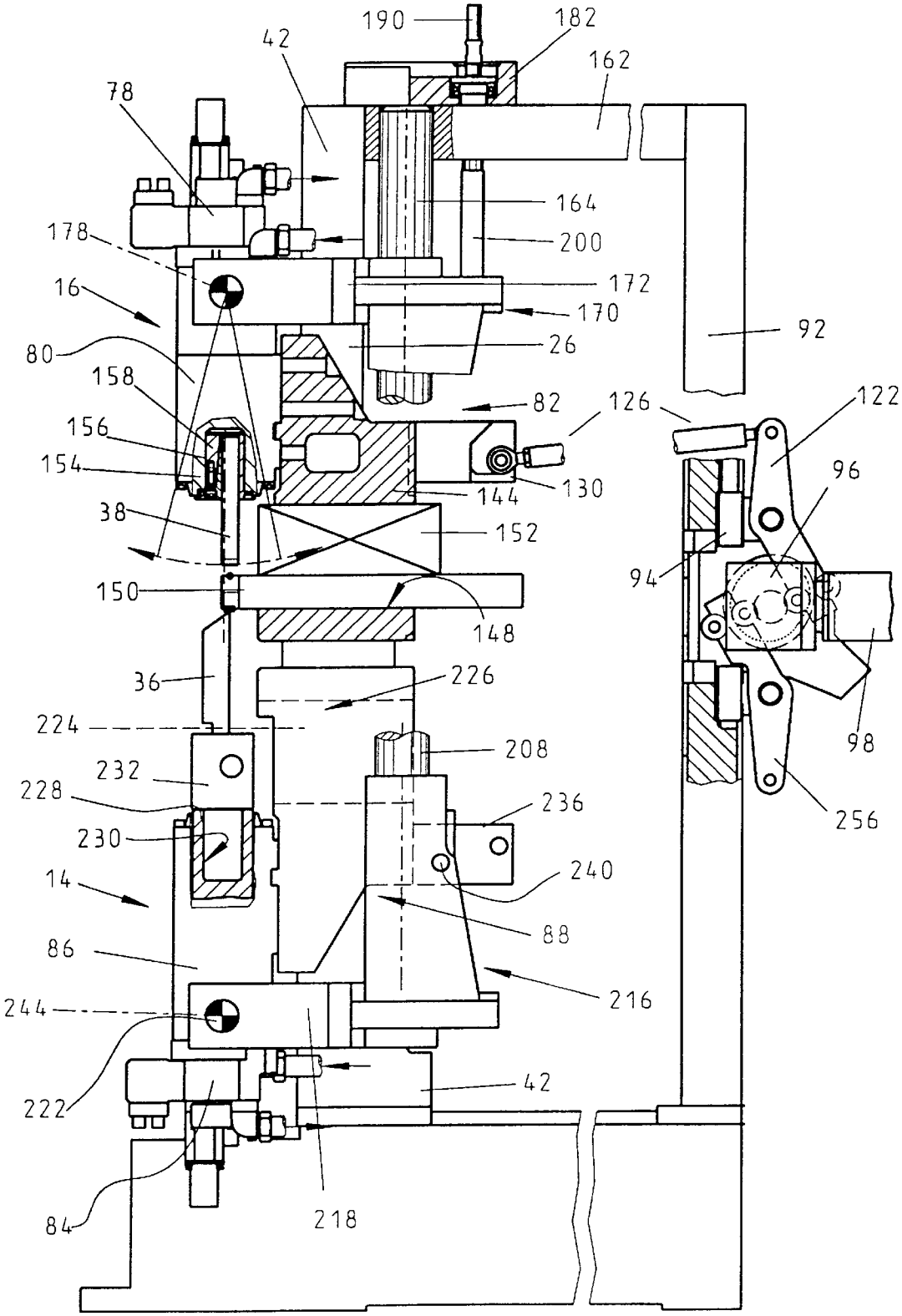
FIG. 2 is a right side view of the embodiment with a longitudinal section taken on the line II—II of FIG. 1.
Figure 3:
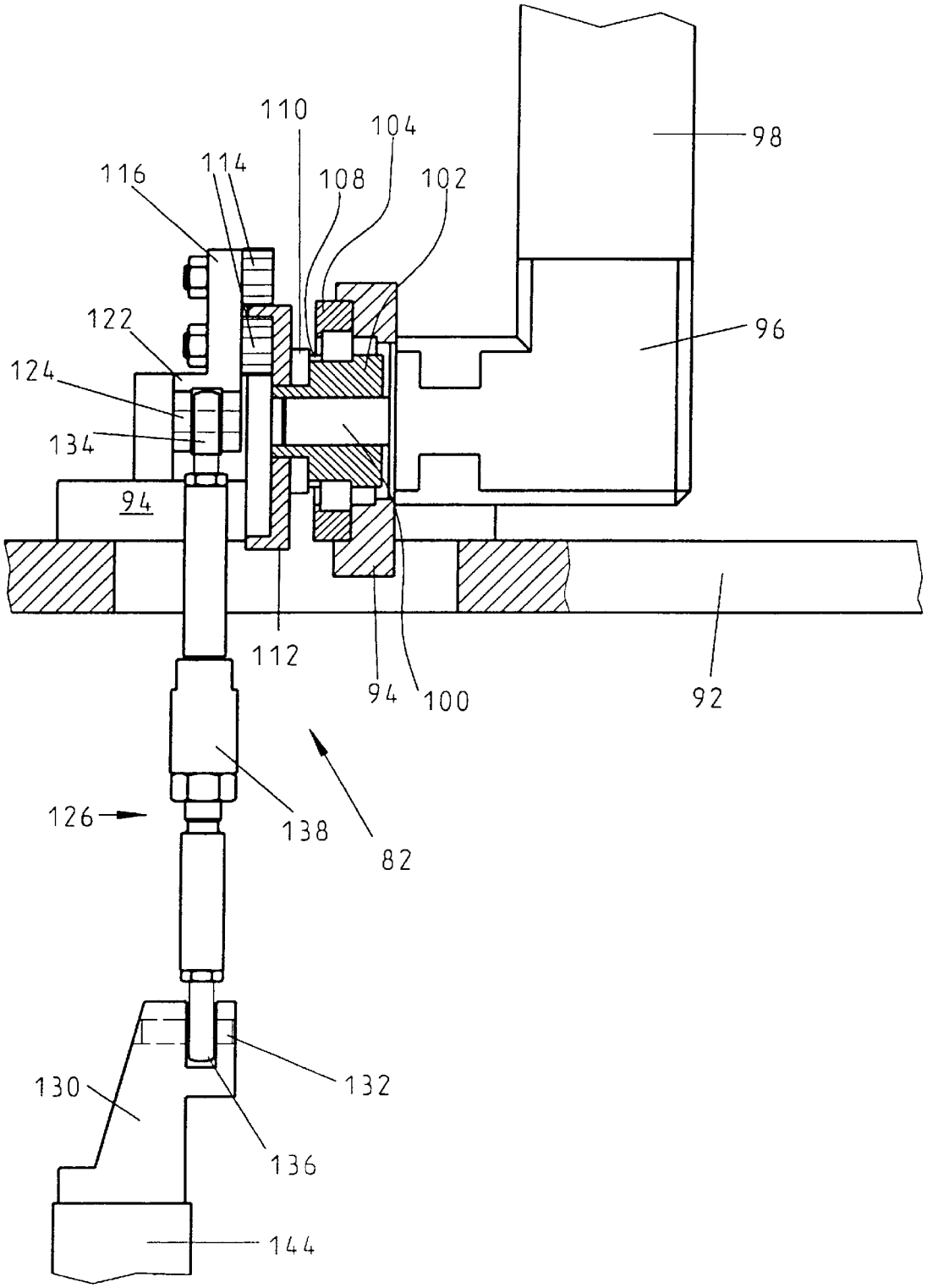
FIG. 3 is a partial top view in direction III of FIG. 1 with the swivelling device of the embodiment shown partly in section.
Figure 4:
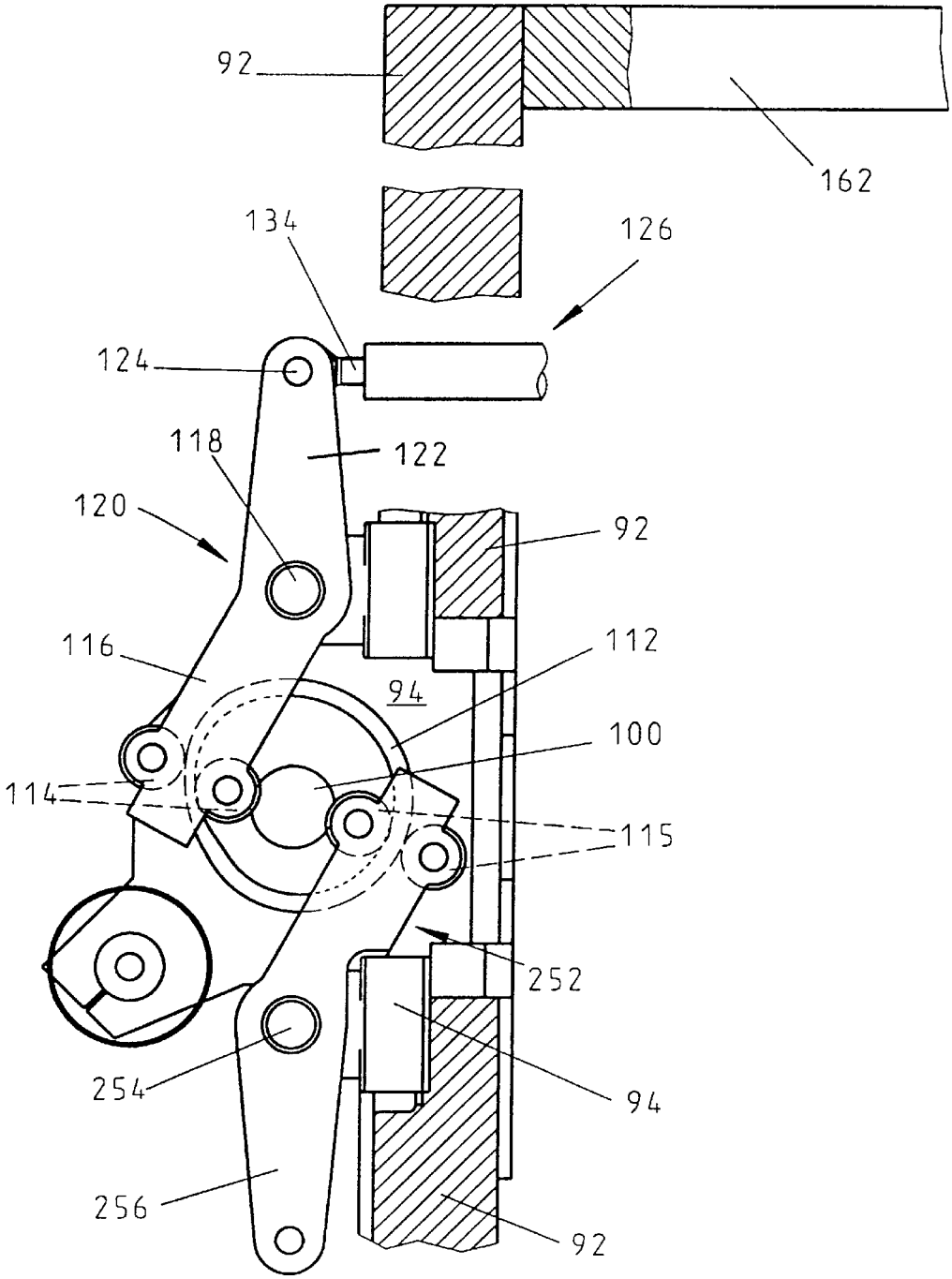
FIG. 4 is a longitudinal section on line IV—IV through the rear wall of the embodiment with view on a part of the swivelling device.
Figure 5:
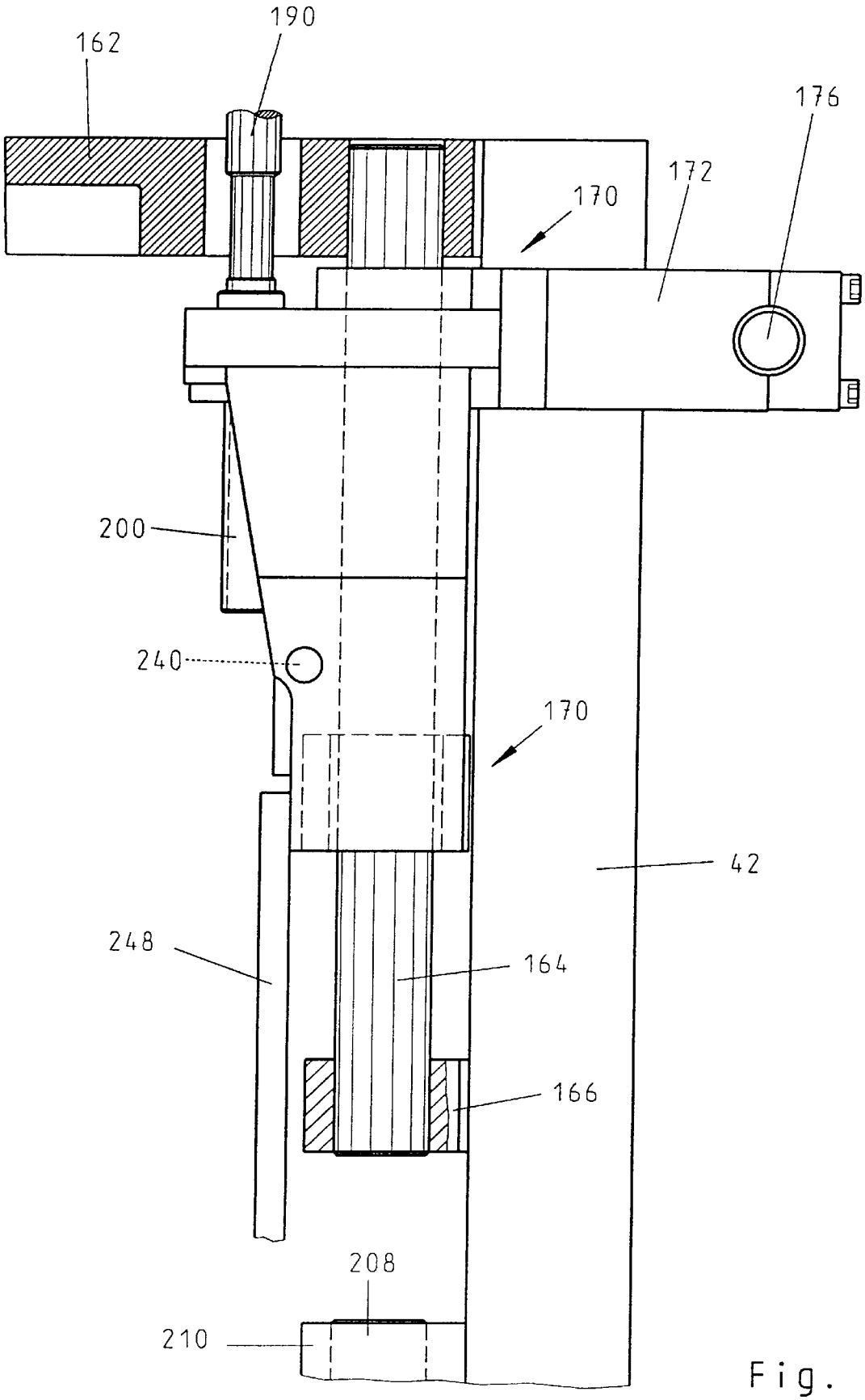
FIG. 5 is a view in direction V of FIG. 1 of the right front wall with the upper slide carriage of the embodiment shown partly in section.
Figure 6:
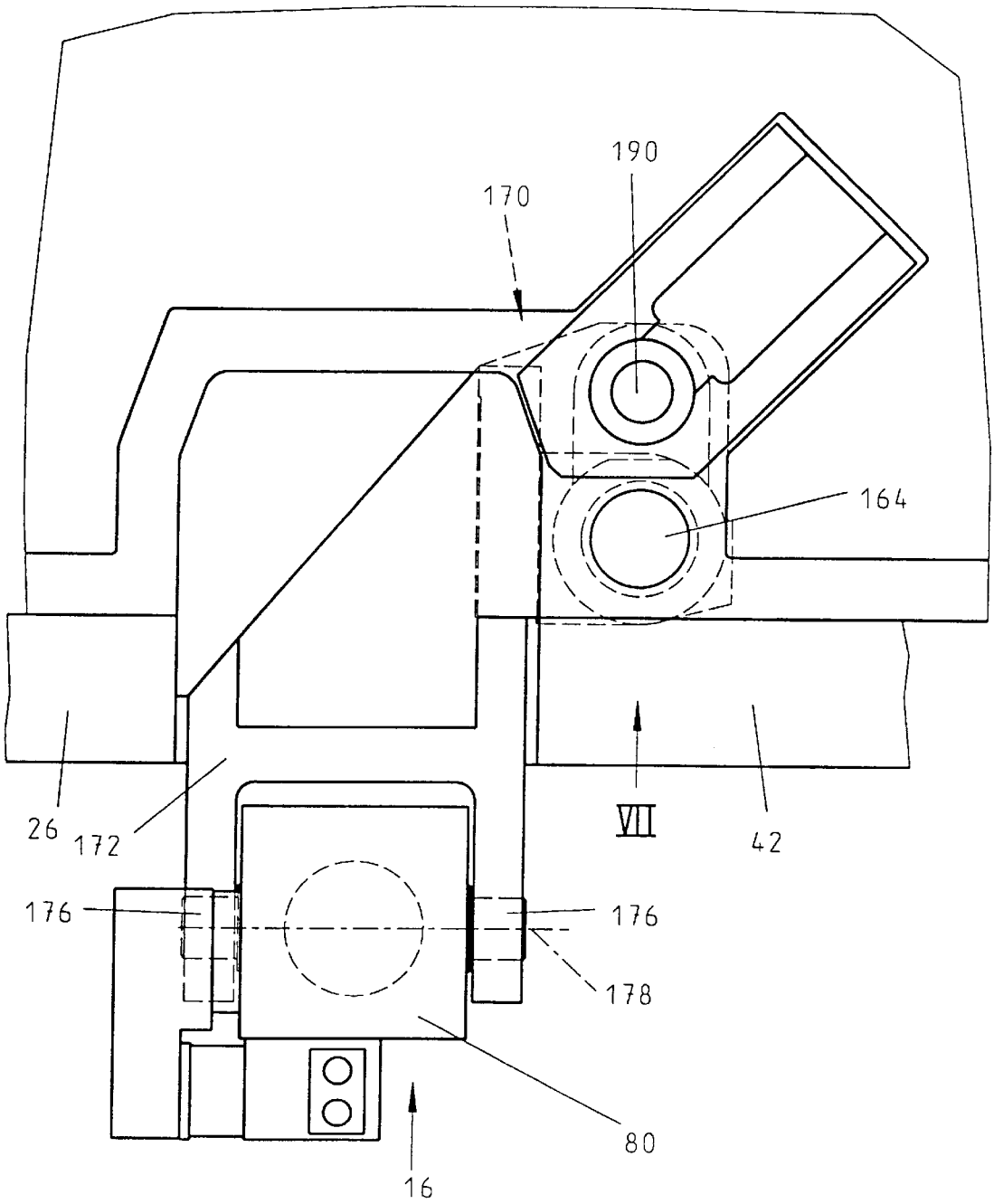
FIG. 6 is a detail in top view in direction VI of FIG. 1 with the cutting device of the embodiment.
Figure 7:
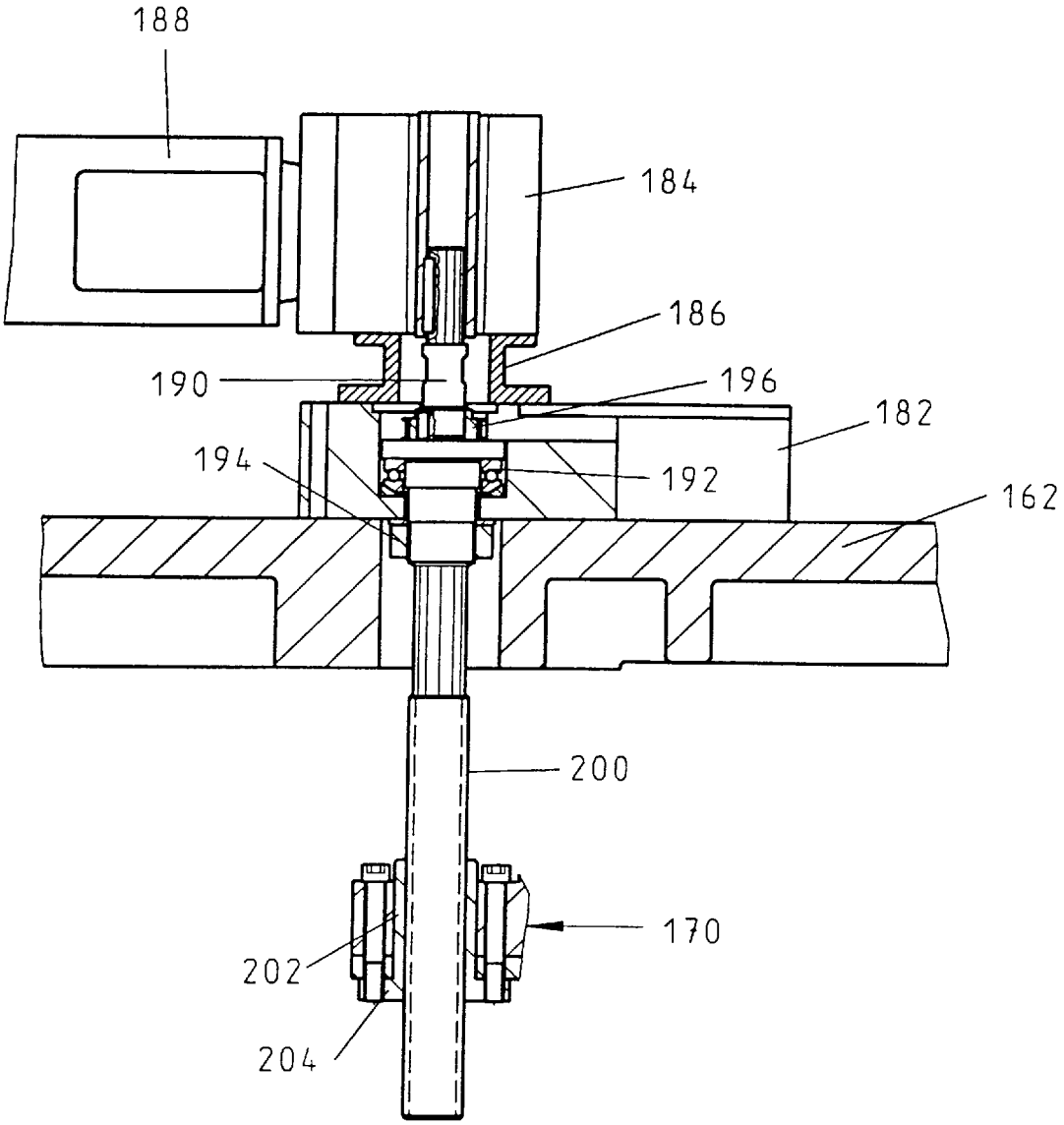
FIG. 7 is an enlarged detail in direction VII of FIG. 1 with the height adjustment of the cutting device shown partly in section.

The spring winding machine shown in total in FIGS. 1 and 2 mainly consists of a wire intake 10, a winding station 12 with pitch device 14 and a cutting device 16. The wire intake 10 is formed for example by four pairs of in total eight wire intake rollers 18 which push an endless wire 20 in straight line horizontally through a wire guide 22 into the winding station 12. The wire intake rollers 18 provided at a left front wall 26 of the machine frame 28 are driven by a not shown CNC-controllable servomotor.

The winding station 12 contains two pin-shaped winding tools 32 and 34 which permanently form the wire 20 running straight towards them, a pitch tool 36, and a cutting tool 38. All tools are adjustable, replaceable, and movable.

Said two winding tools 32 and 34 fixed in two winding devices 44 and 46 arranged one above the other at the right front wall 42 of the machine frame 28, are shaping the wire 20 depending on the setting of the two winding tools 32 and 34 either into right or into left coiled helical springs (positive or negative helicity), i. e. depending on whether the wire 20 is directed upwards or downwards away from the wire guiding axis 48. Construction and operation of the two winding devices 44 and 46 complies with the winding devices 30 and 32 of the spring winding machine disclosed by DE 92 13 164 U1. The few manipulation steps described in this prior art are also necessary for the present apparatus in order to convert the two winding devices 44 and 46 from one winding direction to the other. With regard to the shaping drive of the upper winding device 44 for obtaining the shape of formed springs, there is a beaded control cam 56 at the front side of the right front wall 42 of the machine sitting on a shaft 52 which is driven by a second CNC-controllable servomotor 54, said control cam serving for the conversion of the rotation movement of the shaft 52 over rollers 58 and a lever 60 in known manner into a translational movement of the winding tool 32 corresponding to the rotation angle. The coordinated movement of the winding tool 34 of the lower winding device 46 is controlled by a second beaded control cam 64 over rollers 66 and a lever 68 as well as a joint rod 69 sitting below the shaft 52 on another shaft 70 and driven over a toothed belt transmission 72 by the same servomotor 54.

A variation of the present embodiment is so designed that each of the two control shafts 52 and 70 is driven by its own CNC-controllable servomotor 54 and 74 program-controlled intermittent forward and backward rotating.

This makes it possible that in case of formed springs that are difficult to produce, for example springs with large diameter differences which for example merge into one another within one spring turn, the two winding tools 32 and 34 can be displaced program-controlled separately and thus can be adjusted to special requirements.

For the production of right-handed springs the cutting device 16 with a cutting cylinder 80 is mounted at an upper activated swivelling device 82 whereas the pitch device 14 with a pitch cylinder 86 is provided at a lower passivated swivelling device 88. Both cylinders 80 and 86 are hydraulic cylinder piston aggregates and each one has a program-controlled NC valve 78 and 84.

For the drive of the active swivelling device 82 a bracket 94 is fixed to the rear wall 92 of the machine frame 28, said rear wall being provided with an opening, and to said bracket an angular planetary gear 96 is screwed which is driven by a CNC-controllable servomotor 98. The output shaft pivot 100 of the gear 96 has a nonrotatably fixed driving flange 102 which is guided in a ball bearing in a ring 104 fixed to the bracket 94. At the gear-remote end of the driving flange 102 subsequent to a spacer ring 108 a toothed washer 110 is screwed nonrotatably to said driving flange 102 together with a beaded control cam 112.

The torque introduction by the control cam 112 is executed over two rollers 114 installed at the free end of the arm 116 of a two-armed upper swivelling lever 120 pivoting on a bolt 118 fixed in the bracket 94. At the forked end of the other lever arm 122 of the angular shaped lever 120 a connecting rod 126 engages with a bolt 124 and links the swivelling lever 120 with an upper forked flange 130 by a bolt 132. The connecting rod 126 consists of two head joints 134 and 136 connected with each other by a turnbuckle 138.

The toothed washer 110 is connected by a toothed belt with another toothed washer sitting nonrotatably on the drive shaft pivot of a not shown known position transmitter. The so driven transmitter serves for absolute position monitoring of the swivelling device 82. At the forked flange 130 an upper mandrel support 144 is fixed which is guided slidingly between the lateral front face of the right front wall 42 and the lateral front face of the left front wall 26 of the machine frame 28. In a rectangular opening 148 of the upper mandrel support 144 a cutting mandrel 150 is clamped by means of a known mandrel clamping device 152 which is not shown in detail.

The movable cutting tool 38 of the cutting device 16 is operating together with the cutting mandrel 150 as a counterknife which is stationary during the cutting operation. If necessary for a certain kind of spring, said mandrel 150 can be withdrawn from the winding area by means of a not shown but known device, when no cutting is carried out and after the frictional connection of the mandrel clamping device 152 is loosened.

The housing 81 of the hydraulically operating cutting cylinder 80 of the cutting device 16 is screwed to the end of the upper mandrel support 144 opposite to the forked flange 130. At the end of the cutting cylinder 80 turned towards the cutting mandrel 150 a cutting tool adapter 158 is inserted in an adapter bore 156 in the piston rod 154 of said cutting cylinder and fixed to the piston rod in which the cutting tool 38 is clamped. The upper end of a downward protruding guiding rod 164 is running on bearings in a cross bar 162 which connects the upper end of the right machine front wall 42 with the upper end of the rear wall 92 of the machine frame 28, whereas the lower end of said guide rod 164 is held firmly clamped in a bearing 166 below the cross bar 162 at the right front wall 42. An upper slide carriage 170 is running movably in bearings on the guiding rod 164. In addition, the arm 172 of the slide carriage 170 is guided slidingly at the side between the lateral front face of the right front wall 42 and the lateral front face of the left front wall 26 of the machine frame 28, and is projecting forward from the spring winding machine between said two walls. The arm 172 is forked at its front end and holds between the fork in divided bearing bores two pivots 176 formed at the side of the housing of the cutting cylinder 80 of the cutting device 16. The said pivots 176 form a swivel axis 178 for the torque introduced by the control cam 112 to the swivelling lever 120, which is transmitted over the connecting rod 126 and the forked flange 130 to the upper mandrel support 144 to which the cutting cylinder 80 is fixed, with the result that the entire cutting device 16, consisting of cutting cylinder 80 with cutting tool 30 and upper mandrel support 144 with cutting mandrel 150 including the screw-fixed forked flange 130, is swivelled around said swivel axis 178 away from the cutting line of the cutting device 16, which is approximatively parallel to the machine front walls, towards a line protruding into the drawing plane of FIG. 1. turned inclined away from the viewer. So the cutting tool 30 is swivelled backwards away from the winding plane and sets the latter free. For the outward swivelling motion after the cutting-off of the wire of the formed sping, and for the inward swivelling motion after the winding of a new formed spring, the control cam 112 executes in a CNC-controlled time a limited reciprocating rotation with reference to the servomotor 98. Hereby the rotation amount, i.e. the size of the swivel angle, can also be CNC-controlled.

The entire cutting device 16 with upper mandrel support 144 can be adjusted in height motor-driven with CNC-control, so the position of the cutting mandrel 150 can be adapted to the required winding diameter of the spring and the winding direction.

For this purpose, on the cross bar 162 at the upper end of the machine frame 28 a bearing 182 is installed with a worm gear 184 mounted by means of an intermediate flange 186. Said worm gear 184 is driven by a CNC-controlled servomotor 188 flanged to said gear 184. On the output side a downward protruding spindle 190 is inserted nonrotatably in the gear 184, whereby said spindle rotates in the bearing 182 by means of an axial deep groove ball bearing 192 which takes up the axial forces acting upon the spindle 190. Said spindle 190 is fixed axially adustable in the bearing 182 by means of an adjusting nut 194. Below the intermediate flange 186 a toothed washer 196 is nonrotatably fixed to the spindle 190. Said toothed washer 196 is connected by a toothed belt with another toothed washer installed nonrotatably on the drive shaft pivot of a not shown but known position transmitter. The so driven transmitter is foreseen for position monitoring and/or position indication.

The spindle 190 is provided at its lower half with an exterior thread 200 screwed into a threaded flange bushing 202. The flange 204 of said threaded bushing 202 is fixed by screws to the upper slide carriage 170. By CNC-controlled rotation of the spindle 190 through the servomotor 188, the upper slide carriage 170 and with it the entire cutting device 16 can be shifted or lowered.

On the axial extension of the guiding rod 164 a second guiding rod 208 (which might be conceived united with the first) is provided, the upper end of which is firmly installed in a bearing 210 which is fixed to the right front wall 42 of the machine frame 28, whereas the lower end of the rod 208 is mounted on a bearing in the bottom of the right front wall 42. A lower slide carriage 216 is mounted movably at the lower guiding rod 208. Here, too, an arm 218 of the slide carriage 216 is additionally guided between the left front wall 26 and the right front wall 42 at their lateral front faces. The arm 218 of the slide carriage 216 is forked at its front end and holds between the fork in divided bearing bores two pivots 222 formed at the side of the housing of the pitch cylinder 86 of the pitch device 14. Said housing 87 of the pitch cylinder 86 is firmly connected by screws to a lower mandrel support 226 which is guided laterally between the lateral front face of the right fron wall 42 and the lateral front face of the left front wall 26. It has a rectangular opening 224 corresponding to the opening 148 of the upper mandrel support 144, in which the cutting mandrel 150 with the mandrel clamping device 152 are inserted after their removal from the upper opening 148 when the tools 36 and 38 change places.

The piston rod 228 of the hydraulically operating pitch cylinder 86 has on its side turned towards the cutting mandrel 150, an adapter bore 230 with a pitch tool adapter 232 fixed to said piston rod in which the pitch tool 36 is clamped. A forked flange 236 corresponding to the forked flange 130 of the cutting device 16 is screwed to the end of the lower mandrel support 226 turned away from the pitch cylinder 86. The slide carriages 170 and 216 each have a bore to receive a fixing bolt 240, and the forked flanges 130 and 236 each have an interior thread corresponding to the bolt thread. With regard to the pitch device 14 the lower slide carriage 216 and the lower forked flange 236 are firmly screwed to each other by means of the fixing bolt 240, see FIG. 2. The whole unit consisting of the pitch cylinder 86 including the pitch tool 36, the lower mandrel support 226, and the forked flange 236, is thus fixed unmovably so that any unintentional swivelling away of the unit around the axis 244 of the pivots 222 of the pitch cylinder 86 is eliminated. So the swivel axis 244 is inactive. For this reason during right-hand winding there is no connection from the forked flange 236 to the control cam 112 of the lower swivel axis 88. It has to be mentioned here, that the lower slide carriage 216 is connected with the upper slide carriage 170 by means of a connecting rod 248 so that the lower slide carriage 216 with the pitch device 14 takes part in the CNC-controlled height adjustment of the cutting device 16 described above. Due to this a second controlled positioning axis for the lower slide carriage 216 can be saved.

Since due to the described coupling the pitch device 14 participates in the height adjustment of the cutting device 16, the position of the pitch tool 36 has to be adapted when the cutting device 16 is converted to another spring diameter or when the winding is converted from right-hand to left-hand referred to the drawn-in wire. This is however no problem, as mentioned at the beginning, since the electro-hydraulic NC drive of the pitch device 14 will execute this automatically over the program-controllable stoke position adjustment of the working piston of the pitch cylinder 86 by the machine control. It goes without saying that the stroke position can also be adjusted manually.

It has to be mentioned once more that the intake of the wire, the setting of the outside diameter of a cylindrical spring or the initial diameter of a formed spring, the diameter change during the production of formed springs, the setting of the starting position of the cutting tool, the determination of the cutting stroke, the swivelling of the cutting device, the setting of the starting position of the pitch tool, the movement of the pitch tool, the clamping of the cutting mandrel, if necessary the displacement of the mandrel and the height adjustment of the cutting device, are carried out completely program-controlled by the operation program of the spring winding machine.

However, this shall not exclude that one or the other working or setting procedure (e.g. cutting stroke dimension, inward and outward swivelling of the cutting device) can also be carried out without computer aid.

All details described before apply to the production of right-hand springs where the spring body is formed in upward direction from the horizontal line of the wire guiding axis 48. If the spring winding machine according to this invention has to be converted to the production of left-hand springs where the wire is guided downward by the winding tools 32 and 34, the following has to be done:

- Measures for converting the two winding apparatuses 44 and 46 from right-hand to left-hand winding, see prior art DE 92 13 164 U1.
- Now the cutting cylinder becomes the pitch cylinder and vice versa the pitch cylinder becomes the cutting cylinder so that the cutting tool adapter 158 with cutting tool 38 and the pitch tool adapter 232 must be exchanged from one cylinder to the other, and a pitch tool for left-hand winding must be inserted.
- Change of the cutting mandrel 150 and the mandrel clamping device 152 from the upper mandrel support 144 to the lower mandrel support 226.
- Detachment of the connecting rod 126 from the upper swivelling lever 120 and upper forked flange 130 by removing the bolts 124 and 132.
- Connection of the free lever arm 256 of the lower swivelling lever 252 with two rollers 115, and of the lower forked flange 236 with the detached connecting rod 126.
- Fixing of the upper forked flange 130 and the therewith connected upper mandrel support 144 to the upper slide carriage 170 by removing the fixing bolt 240 from the lower forked flange 236 and inserting it into the upper slide carriage 170 where it is screwed to the upper forked flange 130. The swivel motion of the cutting device 16 away from the cutting plane is now initiated by the lower swivelling device 88 whereas the upper swivelling device 82 is inactivated, i.e. can not be swivelled.

The invention is not limited to the machine type described in the foregoing. A number of changes and modifications are possible without deviating from the basic idea of the invention. For example instead of the electro-hydraulic NC (linear) drives for cut and pitch, electro-pneumatic NC drives can be used, or instead of the controllable (electro-) servomotors 98 and 188 for the program-controlled inward and outward swivelling of the cutting unit and for the height adjustment of the cutting unit 16, for example an appropriate controllable hydraulic or pneumatic rotary drive or an appropriate directly driving linear drive can be used for each of them.

List of Reference Numbers

10=wire intake
12=winding station
14=pitch device 12
16=cutting device
18=wire intake rollers 10
20=wire
22=wire guide
24=
26=left front wall of machine frame 28
28=machine frame
30=
32=winding tool 12
34=winding tool 12
36=pitch tool 14
38=cutting tool 16
40
42=right front wall of machine frame 28
44=winding apparatus
46=winding apparatus
48=wire guide axis 22
50
52=shaft
54=controllable servomotor
56=control cam
58=rollers
60=lever
62
64=control cam
66=roller
68=lever
69=joint rod
70=shaft
72=toothed belt transmission
74=controllable servomotor
76=
78=NC valve
80=cutting cylinder 16
81=housing 80
82=upper swivelling device

84=NC valve
86=pitch cylinder 14
87=housing 86
88=lower swivelling device
90=
92=rear wall of the machine frame 28
94=bracket
96=angular planetary gear
98=controllable servomotor
100=drive shaft pivot of the gear 96
102=driving flange
104=ring
106=
108=spacer ring
110=toothed washer
112=control cam
114=rollers
115=rollers
116=arm of the upper swivelling lever 120
118=bolt
120=upper swivelling lever
122=other arm of the swivelling lever 120
124=bolt
126=connecting rod
128=
130=upper forked flange
132=bolt
134=head joint 126
136=head joint 126
138=turnbuckle 126
140
142
144=upper mandrel support
146
148=opening of the mandrel support 144
150=cutting mandrel
152=mandrel clamping device
154=piston rod 80
156=adapter bore of the piston rod 154 of the cutting cylinder 80
158=cutting tool adapter
160
162=cross bar
164=guiding rod
166=bearing
168
170=upper slide carriage
172=arm of the slide carriage
174
176=pivot of the cutting cylinder 80
178=swivel axis
180=
182=bearing
184=worm gear
186=intermediary flange
188=controllable servomotor
190=spindle
192=axial deep groove ball bearing
194=adjusting nut
196=toothed washer
198=
200=outside thread of the spindle 190
202=threaded flange bushing
204=flange of the threaded bushing 202
206=
208=guiding rod
210=bearing
212=
214=
216=lower slide carriage
218=arm of the slide carriage 216
220=
222=pivot of the pitch cylinder 86
224=opening 226
226=lower mandrel support
228=piston rod 86
230=adapter bore of the piston rod 228 of the pitch cylinder 86
232=pitch tool adapter
234=
236=lower forked flange
238 0
240=fixing bolt
242=
244=swivel axis of the pivot 222
246=
248=connecting rod
250=
252=lower swivelling lever
254=bolt
256=arm of the swivelling lever 252

What is claimed is:

1. A wire shaping apparatus comprising a wire guide, a wire shaping station, at an end of said wire guide, in which shaping tools for shaping endless intaken wire are provided, and a wire cutting device having a drive for a movable cutting tool which during cutting is working together with a stationary cutting tool to cut the wire at a meeting point of the two cutting tools, said drive including a fluid operated cylinder piston assembly having a movable piston portion to which the movable cutting tool is mounted for movement in a shearing direction, and a cylinder portion, said cylinder portion being movable in at least one direction diverging from the shearing direction, from and back to a plane defined by a wire guiding direction and the shearing direction which intersect at the wire shaping station.

2. Apparatus according to claim 1, wherein the cylinder portion is mounted on an arm for rotation about a swivel axis which is perpendicular to the shearing direction and parallel to the wire guiding direction, said arm being stationary during a cutting action, and whereby said cylinder portion is swivelled by means of a swivel drive in at least one direction away from and back to the plane defined by the wire guiding direction and the shearing direction.

3. Apparatus according to claim 1, further comprising a second fluid operated cylinder piston assembly including a second cylinder portion and a second movable piston portion, the second piston portion being movable in a direction parallel to the shearing direction, and the second piston portion having an adapter for coupling thereto a shaping tool or a cutting tool.

4. Apparatus according to claim 1, wherein the fluid operated cylinder piston assembly is controlled by a program-controllable NC valve.

5. Apparatus according to claim 1, wherein the piston portion is movable in the shearing direction in line with the movable cutting tool.

6. Apparatus according to claim 2, wherein the cylinder portion is fixedly connected to a tool support which supports the stationary cutting tool, and said tool support is connected articulately with a swivel lever of a cam gear of the swivel drive.

7. Apparatus according to claim 2, wherein said arm is provided with a carriage which slides along a guide rod extending parallel to the shearing direction and which is adjustable by means of a shifting drive.

8. Apparatus according to claim 6, further comprising a movable carriage for the arm, wherein the carriage and the tool support are attached to each other with a detachable rigid connection.

9. Apparatus according to claim 6, wherein a second cylinder portion is fixed to a second tool support for optional holding of the stationary cutting tool, and said second tool support is articulately connected with a second swivel lever of a second cam gear of a second swivel drive.

10. Apparatus according to claim 7, wherein the carriage and the tool support are attached to each other with a detachable rigid connection.

11. Apparatus according to claim 3, wherein the second cylinder portion is mounted at a second arm and is rotatable around a swivel axis which is perpendicular to the moving direction of the second piston portion and parallel to the wire guiding direction, said second arm being stationary during the shaping action, and whereby said second cylinder portion is swivelable by means of a second swivel drive in at least one direction away from and back to the plane defined by the wire guiding direction and the shearing direction where the shaping takes place.

12. Apparatus according to claim 11, wherein the second arm is provided with a second carriage which slides along a guide rod extending parallel to the shearing direction and which is adjustable by means of a shifting drive.

13. Apparatus according to claim 11, wherein the second cylinder portion is fixedly connected to a second tool support which supports the stationary cutting tool, and said second tool support is articulately connected with a second swivel lever of a cam gear of the second swivel drive.

14. Apparatus according to claim 9, wherein a displaceable rod is interchangeably connectable between the first or second tool support and the first or second swivel lever.

15. Apparatus according to claim 9, wherein the swivel drive and the second swivel drive are formed by a common swivel drive having separate roller pairs and separate swivel levers for connection to the tool support and the second tool support.

16. Apparatus according to claim 12, wherein the second carriage and the second tool support are attached to each other with a detachable rigid connection.

17. Apparatus according to claim 12, wherein the carriages are connected fixedly to each other and the carriages are adjustable with a common shifting drive.

* * * * *